US009132952B1

(12) United States Patent
Knepp

(10) Patent No.: US 9,132,952 B1
(45) Date of Patent: Sep. 15, 2015

(54) MOBILE FIBER DISPENSER

(71) Applicant: Darrell Knepp, Sarasota, FL (US)

(72) Inventor: Darrell Knepp, Sarasota, FL (US)

(73) Assignee: VM Fiber Feeders, Inc., Sarasota, FL (US)

( * ) Notice: Subject to any disclaimer, the term of this patent is extended or adjusted under 35 U.S.C. 154(b) by 37 days.

(21) Appl. No.: 14/151,410

(22) Filed: Jan. 9, 2014

Related U.S. Application Data

(60) Provisional application No. 61/750,373, filed on Jan. 9, 2013.

(51) Int. Cl.
*B67D 1/00* (2006.01)
*B65D 83/00* (2006.01)

(52) U.S. Cl.
CPC ..... *B65D 83/0083* (2013.01)

(58) Field of Classification Search
CPC .... B65D 83/0083; B65D 83/06; A01F 29/06; A01F 25/16; A01F 29/005; B02C 2013/28654; G01F 13/005
USPC ..... 222/63, 290, 412, 413, 410, 367, 368, 222/333; 366/20, 156.1, 35, 38, 50, 59, 366/76.4; 19/65 A, 97.5; 406/59; 119/57.7
See application file for complete search history.

(56) References Cited

U.S. PATENT DOCUMENTS

| | | | | |
|---|---|---|---|---|
| 2,538,891 | A * | 1/1951 | Zimmerman et al. | 366/156.1 |
| 2,550,354 | A * | 4/1951 | Jacobsen | 406/65 |
| 3,377,000 | A * | 4/1968 | Mason, Jr. | 222/227 |
| 3,529,870 | A * | 9/1970 | Woten | 406/53 |
| 3,885,774 | A | 5/1975 | Harris et al. | |
| 4,023,706 | A | 5/1977 | Dearlove et al. | |
| 5,261,743 | A * | 11/1993 | Moller | 366/196 |
| 5,358,331 | A * | 10/1994 | Cruse | 366/160.3 |
| 5,407,139 | A * | 4/1995 | Mleczewski | 241/18 |
| 5,524,796 | A * | 6/1996 | Hyer | 222/241 |
| 5,931,610 | A | 8/1999 | Rixom et al. | |
| 5,947,645 | A | 9/1999 | Rixom et al. | |
| 6,550,362 | B1 | 4/2003 | Galinat et al. | |
| 6,979,116 | B2 * | 12/2005 | Cecala et al. | 366/132 |
| 7,270,469 | B2 * | 9/2007 | Goode et al. | 366/27 |
| 7,736,569 | B2 | 6/2010 | Baur et al. | |
| 8,162,243 | B2 | 4/2012 | Wenthe et al. | |
| 2004/0170759 | A1 * | 9/2004 | Bardos et al. | 427/212 |
| 2004/0255429 | A1 | 12/2004 | Clausen | |

FOREIGN PATENT DOCUMENTS

WO 2009014952 A1 1/2009

* cited by examiner

*Primary Examiner* — Lien Ngo
(74) *Attorney, Agent, or Firm* — Nilay J. Choksi; Smith & Hopen, P.A.

(57) ABSTRACT

A mobile fiber dispenser that dispenses a variety of types and lengths of pre-cut fibers. The main body of the dispenser is a cylindrical hopper. The pre-cut fibers are loaded into the top of the hopper. Inside the body of the dispenser is a counter auger that keeps the fibers from bridging and clumping. As the fibers pass through the counter auger, they drop into a feed auger that pushes the fibers through an auger housing toward a declumping apparatus. The counter auger and feed auger rotate in the same direction. The declumping apparatus at the end of the auger housing and feed auger intercepts the fibers as the fibers exit the auger housing. The declumping apparatus provides an even distribution of the pre-cut fiber through a discharge chute that extends downward from the auger housing. The fibers are discharged into a field vehicle's mixing process or other collection apparatus.

15 Claims, 9 Drawing Sheets

MOBILE FIBER DISPENSER

CROSS-REFERENCE TO RELATED APPLICATIONS

This nonprovisional application is a continuation of and claims priority to provisional application No. 61/750,373, entitled "Mobile Fiber Dispenser", filed Jan. 9, 2013 by the same inventor, the contents of which are incorporated herein by reference.

BACKGROUND OF THE INVENTION

1. Field of the Invention

This invention relates, generally, to manufacturing and application of fiber-reinforced concrete and asphalt. More specifically, it relates to an apparatus and methodology for dispensing pre-cut fibers to "on-demand" mixing processes in asphalt and concrete industries, where the addition of such fibers is required at the job site.

2. Brief Description of the Prior Art

Adding various types of Fibers to the mixes of mobile equipment such as asphalt slurry seal, asphalt micro surfacing, and volumetric concrete trucks, among other mobile equipment that require the fibers be added at the job site, has been a long standing practice in these industries. These "on-demand" processes require that the fiber be added at the job site into specific mixing processes. Even though adding fiber to theses mixing processes improves the overall quality and performance of the final product, the difficulty and cost of adding the fiber to these on-demand processes by the contractor often outweighed the benefits of adding the fiber.

Historically, fibers have been added by hand, by the use of on-demand fiber choppers that chop continuous strands into pre-determined lengths, or volumetric dispensers that use pre-chopped fibers. When pre-cut fibers are added by hand, it is nearly impossible to achieve even distribution and quantity of fiber into the mixing process. On-demand choppers provide an adequate method of adding fiber, but require a significant amount of maintenance and constant monitoring to ensure that the fiber is being added properly. Various volumetric dispensers have been tried with very little success. Other dispensers do not provide an even distribution of the pre-cut fibers as the fibers has a tendency to clump and bridge during the dispensing process which negatively affects the quality of the final product.

Certain mechanistic fiber dispensers do exist in the prior art. Examples include U.S. Pat. No. 7,736,569 to Baur et al; U.S. Pat. No. 5,947,645 to Ives et al; U.S. Patent Pub. No. 2004/025542 to Clausen; U.S. Pat. No. 5,931,610 to Ives et al.; PCT Pub. No. WO2009014952 to Ramnarine; U.S. Pat. No. 6,550,362 to Galinat et al; U.S. Pat. No. 3,885,774 to Clipston et al.; and U.S. Pat. No. 4,023,706 to Dearlove et al. However, each of the foregoing references are very complex and have many moving parts, thus overcomplicating the manufacture, use and maintenance of the apparatus. Additionally, the foregoing references can be inaccurate and importantly fail to provide an even distribution of fiber in the concrete.

U.S. Pat. No. 8,162,243 to Wenthe et al. ("Wenthe") discusses an apparatus for breaking up fiber and transporting the fiber. Wenthe utilizes a rectangular intake chute into which larger fiber masses are placed or dropped. Within the intake chute are vertically-oriented fan-type structures that rotate such that the blades contact the fiber masses and split or separate pieces of fiber from the mass. The fan-type structures each rotate in the same counterclockwise direction. The separated pieces of fiber are a bit larger, and as such, sprockets are positioned underneath the fan-type structures. Adjacent sprockets rotate in opposite directions. The larger pieces of fiber are contacted by the sprockets, thereby further breaking up the larger pieces of fiber into smaller pieces of fiber. The smaller pieces of fiber subsequently drop onto a conveyor belt that transports the smaller pieces of fiber horizontally to a collection bin or other apparatus as desired by the user. There are several drawbacks to the Wenthe apparatus, though, for example the inability to mobilize the apparatus, the potential for fibers to become clogged in the system, and inefficiencies in fiber distribution, among others.

Accordingly, what is needed is a mobile fiber dispenser for pre-cut fibers that is easier to use, more accurate, requires less maintenance, and is more cost effective. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an improved mobile fiber dispenser for job site on-demand addition of pre-cut fibers, and more efficient method of manufacture thereof, is now met by a new, useful, and nonobvious invention.

In an embodiment, the current invention is a mobile fiber dispenser for even or patterned distribution of an additive into a base material. The dispenser includes a hopper (body) with a substantially impermeable outer wall and a substantially hollow interior for receiving the additive. A counter auger is disposed within the hopper, and a feed auger is disposed underneath the counter auger. The counter auger and feed auger rotate in the same direction. A rotating declumping apparatus is structurally associated with the feed auger, and an output system is associated with the declumping apparatus. In operation, upon being loaded into the hopper, the additive would follow a path of travel through the counter auger to the feed auger, and subsequently to the declumping apparatus into the output system. One or more motors are included to power or control the rotation of the counter auger, feed auger, and declumping apparatus.

The additive may be a fibrous material.

The base material may be concrete, cement, or asphalt, or other materials that would require fiber to be added "on demand" (e.g., soil).

An inductive sensor may be included in electrical communication with the motor that powers or controls the counter and feed augers. The inductive sensor aids in controlling the speed of rotation of the counter and feed augers by providing a signal to an LED panel display or other electronic device, possibly mounted on the dispenser, so that the operator can control the speed of the hydraulic motor manually or automatically.

The motor that controls the counter and feed augers may be a hydraulic motor. In a further embodiment, the hydraulic motor can be connected to a hydraulic pump of a field vehicle that uses the mobile dispenser.

The motor that controls the declumping apparatus may be a direct current motor. In a further embodiment, the direct current motor can be connected to an electrical panel of a field vehicle that uses the mobile dispenser.

The declumping apparatus may have a constant speed at which it rotates when activated.

The output system may include a vertically-directed discharge chute positioned directly under the declumping apparatus. The discharge chute receives the additive as the additive exits the declumping apparatus.

An auger housing may be positioned underneath the hopper, where the auger housing contains the feed auger and declumping apparatus and thus is in open communication with the hopper, as the additive follows a path of travel from the counter auger to the feed auger.

The declumping apparatus may be coupled to and concentric with the feed auger, such that the additive travels horizontally from the feed auger to the declumping apparatus.

The motor that powers or controls the counter and feed augers can function through a belt or chain drive system. In a further embodiment, an inductive sensor may be included in electrical communication with the motor that powers or controls the counter and feed augers. The inductive sensor aids in controlling the speed of rotation of the counter and feed augers. In this case, a sensor target can be disposed on the belt or chain drive system that drives rotation of the counter and feed augers.

The motor that powers or controls the declumping apparatus can function through a belt or chain drive system.

The declumping apparatus may include a plurality of planar blades that drive the additive toward the output system.

In a separate embodiment, the current invention is a mobile dispenser for even or patterned distribution of a fibrous material into concrete, cement, or asphalt. The dispenser includes a hopper (body) with a substantially impermeable outer wall and a substantially hollow interior for receiving the additive. A horizontally-oriented counter auger is disposed within the hopper. An auger housing is disposed underneath the hopper but in open communication with the hopper. A horizontally-oriented feed auger is disposed within the auger housing in underlying relation to the counter auger in a manner that the fibrous material follows a path of travel from the counter auger to the teed auger within the auger housing. The counter auger and feed auger rotate in the same direction. A rotating declumping apparatus is disposed within the auger housing and rotates at a constant speed. The declumping apparatus is coupled to and concentric with the auger housing, such that the fibrous material travels horizontally from the feed auger to the declumping apparatus. A hydraulic motor powers or controls the counter and feed augers through a belt or chain drive system. The hydraulic motor is connected to a hydraulic pump of a field vehicle that is using the mobile dispenser. A direct current motor powers or controls the declumping apparatus through a belt or chain drive system. The direct current motor is connected to an electrical panel of the field vehicle. An inductive sensor is included in electrical communication with the hydraulic motor that powers or controls the counter and feed augers. The inductive sensor aids in controlling the speed of rotation of the counter and feed augers by providing a signal to an LED panel display or other electronic device, possibly mounted on the dispenser, so that the operator can control the speed of the hydraulic motor manually or automatically. A sensor target is disposed on the belt or chain drive system that drives rotation of the counter and feed augers. A vertically-directed discharge chute is disposed directly under the declumping apparatus such that the fibrous material follows a path of travel from the declumping apparatus vertically through the discharge chute, The discharge chute receives the fibrous material as the fibrous material exits the feed auger and declumping apparatus.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
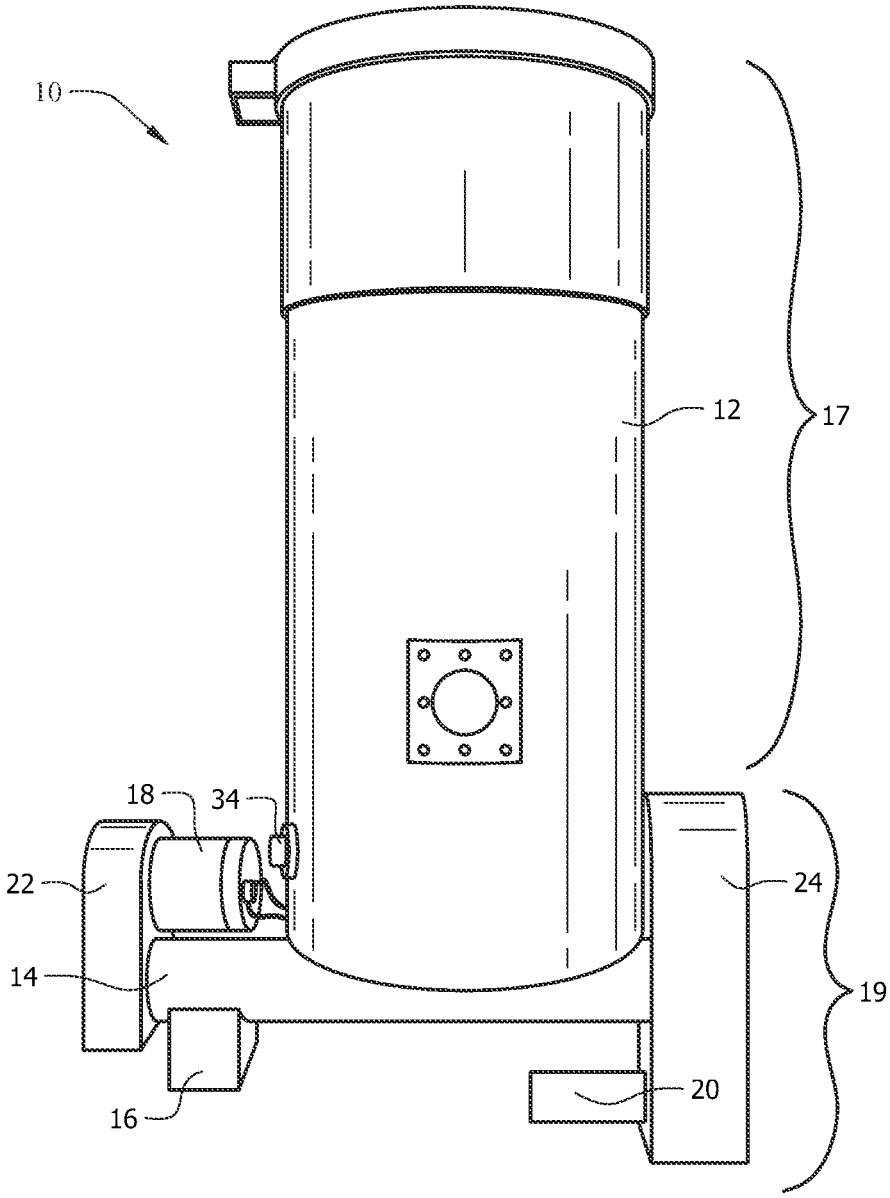
FIG. 1 is a front view of a fiber dispenser according to an embodiment of the current invention.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

Generally, the current invention is a mobile fiber dispenser that dispenses a variety of types and lengths of pre-cut fibers. The main body of the dispenser is a cylindrical drum. The pre-cut fibers are loaded into the top of cylindrical drum or hopper. Inside the body of the dispenser, there is a counter auger that keeps the fibers from bridging and clumping. As the fibers pass through the counter auger, they drop into a feed auger that pushes the fibers through a feed tube toward a declumper or declumping apparatus. The counter auger rotates in the same direction as the feed auger. At the end of the feed tube is the declumping apparatus that intercepts the fiber as it exits the feed tube. The declumping apparatus provides an even distribution of the pre-cut fiber through a discharge chute that extends downward from the feed tube. At this point, the fiber is discharged into a field vehicle's mixing process or other collection bin/apparatus.

In an embodiment, the feed auger and counter auger are powered by a hydraulic motor that attaches to the field vehicle's main hydraulic pump. The dispenser can be equipped with an inductive sensor so that the operator can control the speed of the auger, which determines the amount of fiber being added to the specific mixing process. The inductive sensor provides a signal to an LED panel display or other electronic device, possibly mounted on the dispenser, so that the operator can control the speed of the hydraulic motor manually or automatically. The declumping apparatus, which is mounted on/beneath the feed tube, can be controlled by a 12-volt D/C motor that is wired into the field vehicle's electrical panel.

The fiber dispenser is capable of dispensing any variety of types and lengths of pre-cut fibers.

In an embodiment, the present invention relates to a machine or apparatus for dispensing pre-cut fibers to "on-demand" mixing processes in the asphalt, concrete and other industries that require the addition of such fibers at the job site. Generally the fiber dispenser has a cylindrical shaped body which holds the pre-cut fibers. A counter auger is mounted in the body and rotates in the same direction of the feed auger, which is positioned below the counter auger. The feed auger is housed inside a feed tube underneath the body. Both the counter auger and the feed auger are powered by a hydraulic motor that attaches to the field vehicle's main hydraulic pump. Both the feed auger and the counter auger rotate via the use of a belt or chain drive, including belt/chain and sprocket. The counter auger keeps the pre-cut fibers from clumping and bridging inside the fiber dispenser body. The feed auger is housed inside the feed/auger tube, so that as the pre-cut fibers enter the feed auger, they are moved towards the end of the auger tube. A de-clumping apparatus, positioned at the end of the auger tube, rotates at a constant speed and intercepts the pre-cut fiber as it is pushed out of the auger. The de-clumping apparatus is powered by a 12V motor mounted to the end of auger tube and rotates via the use of a belt or chain drive, including a belt/chain and sprocket. The 12V motor can be connected to the field vehicle's electrical system for a power source. The de-clumping apparatus provides an even distribution of the pre-cut fiber through the discharge chute and into the field vehicle's mixing process. The fiber dispenser can further include an inductive sensor that is mounted with the hydraulic motor that powers the rotation of the augers. The inductive sensor provides a signal to the field vehicle's main control panel so that the operator can control the speed of the hydraulic motor.

Example

Figure 2:
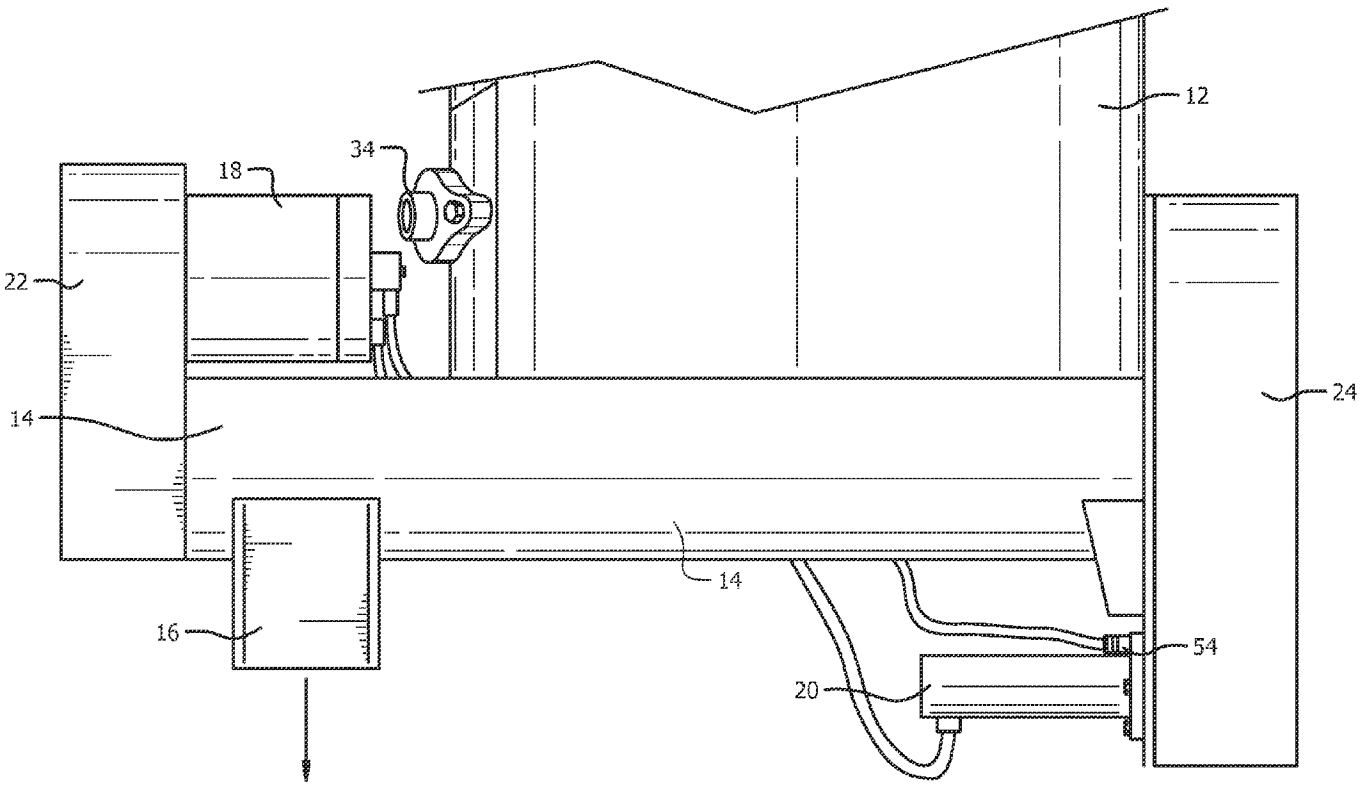
FIG. 2 is a close-up exterior view of a lower portion of a fiber dispenser according to an embodiment of the current invention.

In an embodiment, as depicted in FIGS. 1-2, the current invention is a fiber dispenser, generally denoted by the reference numeral 10. Fiber dispenser 10 includes hopper or drum 12, auger housing 14, discharge chute 16, motor 18, sensor 54, and gear housings 22, 24.

Hopper 12 is substantially hollow (with exception to a counter auger that will become more apparent as this specification continues) and is formed of a substantially impermeable material. Hopper 12 is structured to receive fiber desired to be dispensed in an even, steady, or patterned manner (i.e., not clumped).

Auger housing 14 is elongate and is positioned beneath hopper 12 and is secured to hopper 12 via welding or other mechanism. Gear housing 22 is positioned on one end of auger housing 12, and gear housing 24 is positioned on the opposite end of auger housing 14. The mechanisms taking place within gear housings 22, 24 will become more apparent as this specification continues.

Discharge chute 16 is secured (e.g., welded) to auger housing 14 and extends downwardly from auger housing 14 or in a direction desired by the user for outputting or discharging the cut fiber.

Motor 18 may be secured to mounting plate 21 and drives the operation of gears (not seen in this figure) and the rotation of augers (feed auger and counter auger, not seen in this figure). The placement of motor 18 is not pertinent to the operation of fiber dispenser 10, as long as motor 18 is in communication with the gears and augers to ensure proper operation of fiber dispenser 10.

Figure 6:
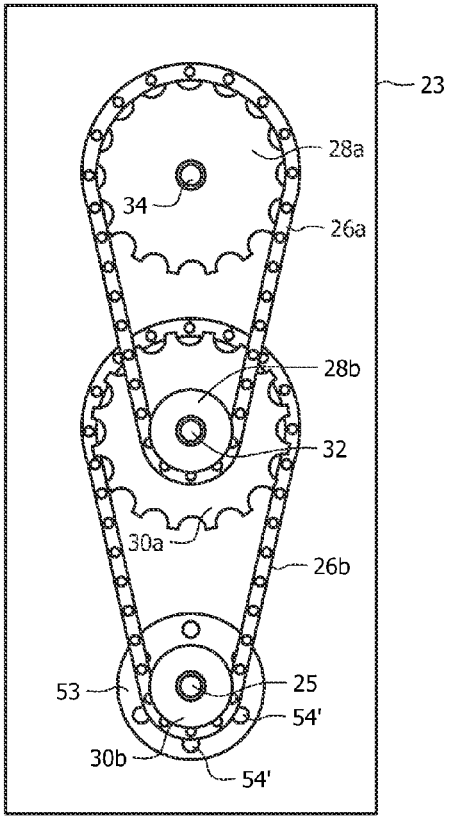
FIG. 6 is a close-up front view of exemplary mechanisms used to rotate a feed auger and a counter auger in a fiber dispenser according to an embodiment of the current invention.
Figure 7:
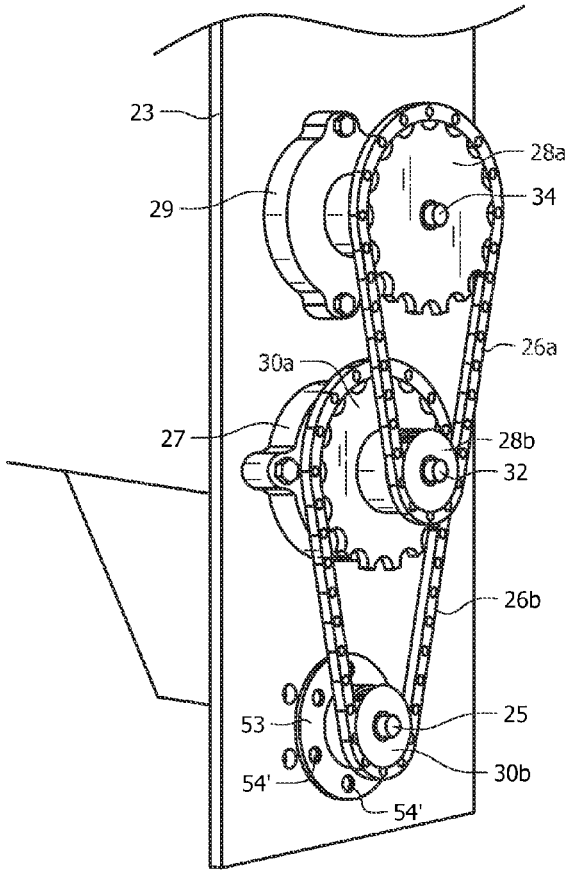
FIG. 7 is a close-up perspective view of the mechanisms of FIG. 6.

Sensor 54 is an inductive sensor that is in communication with motor 20 to aid in controlling the rotational speed of feed auger 46 and counter auger 48. Apertures 54' on base 53, as seen in FIGS. 6 and 7, are targets for inductive sensor 54. Inductive sensor 54 detects the absence of metal at targets 54' and in that manner determines speed of rotation of feed auger 46 and counter auger 48. Inductive sensor 54 would be programmed based on number of targets 54' per revolution of feed auger 46 and counter auger 48. Thus, inductive sensor 54 can calculate the rotational speed thereof. Inductive sensor 54 provides a signal to an LED panel display or other electronic device(s) (e.g., a PLC) that can be utilized to control the speed of motor 20. The LED panel display or other electronic device(s) may be mounted on dispenser 10 so that the operator can control the speed of hydraulic motor 20 manually or automatically. Alternatively, the electronic device(s) can be mounted elsewhere but still providing the ability for the operator or field vehicle equipment to manually or automatically control the speed of motor 20. If hydraulic motor 20 is connected to the hydraulic pump of the field vehicle, the operator can view the rotational speed of feed auger 46 and counter auger 48 and increase or decrease flow control (e.g., hydraulic fluid) from the hydraulic pump of the field vehicle that speed up or slows down motor 20. Subsequently, based upon the field vehicle utilized, rotation of feed auger 46 and counter auger 48 can be increased or decreased manually or automatically. Thus, inductive sensor 54 itself does not control rotational speed of feed auger 46 and counter auger 48 but relays information of the rotational speed, so that the operator or field vehicle equipment can increase or decrease the rotational speed.

Any suitable field vehicle known or not known in the art can be utilized with embodiments of the current invention. Examples include, but are not limited to, slurry seal trucks and volumetric concrete trucks, such as those made by BERGKAMP or CEMEN TECH, which are incorporated herein by reference. Certain field vehicles have programmable logic controllers that are capable of reading information from inductive sensor 54 and automatically increasing or decreasing speed of motor 20, while other field vehicles force an operator to manually perform this function. One of ordinary skill in the art would understand how to install mobile dispenser 10 on a field vehicle, including connections from motor 20 to the vehicle's hydraulic pump and motor 18 to the vehicle's electrical panel.

Figure 3:
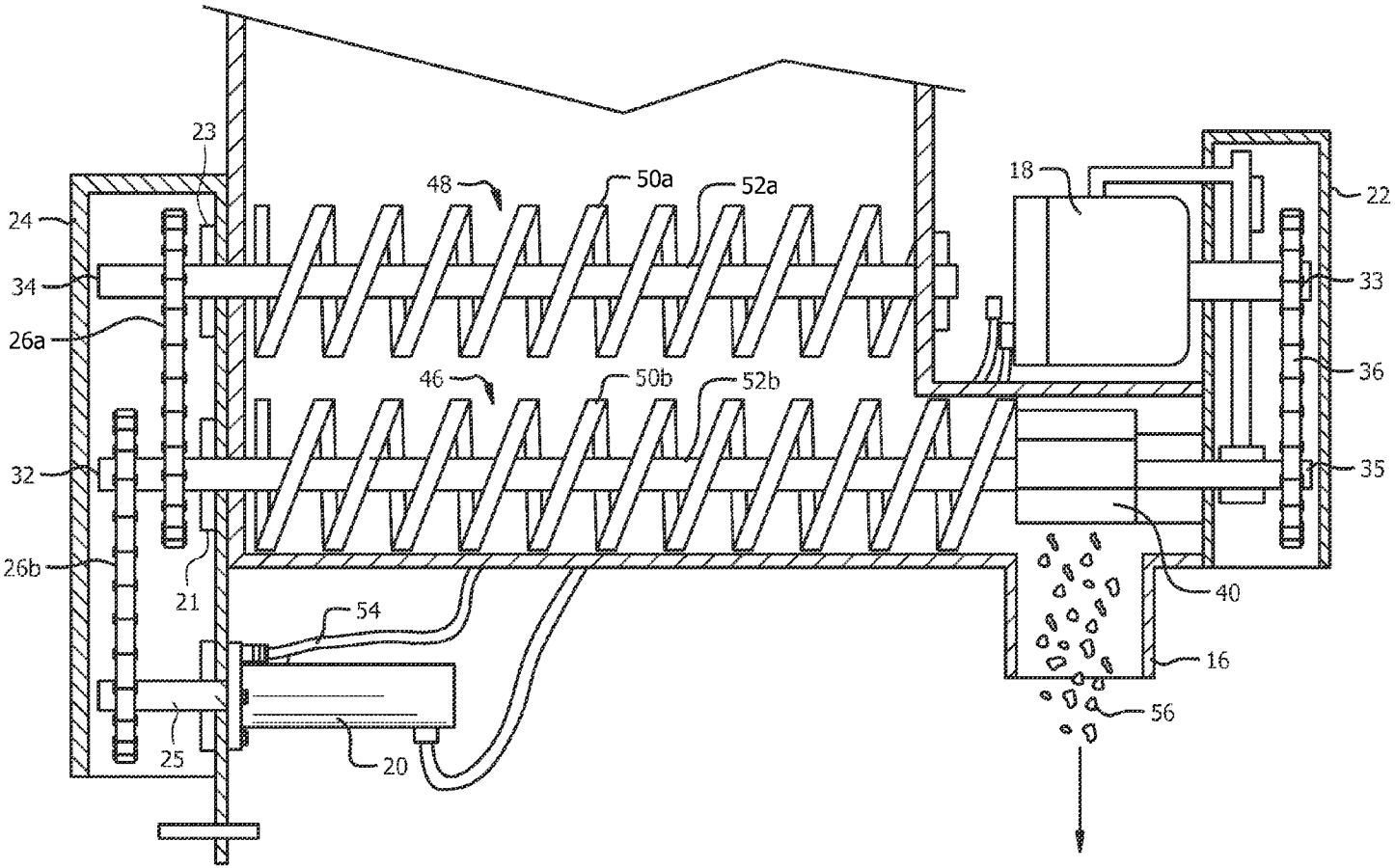
FIG. 3 is a cross-section view of a lower portion of a fiber dispenser according to an embodiment of the current invention.

FIGS. 3-8 shows specifics of the interior structures and mechanisms of apparatus 10. FIG. 3 is a cross-sectional view of lower portion 19 of apparatus 10, including, for example, the bottom of hopper 12, auger housing 14, discharge chute 16, mounting plates 21, 23, and gear housings 22, 24. Upper portion 17 of apparatus 10 (not seen in this figure) is formed substantially of a portion of hopper 12 that is substantially hollow.

Figure 4A:
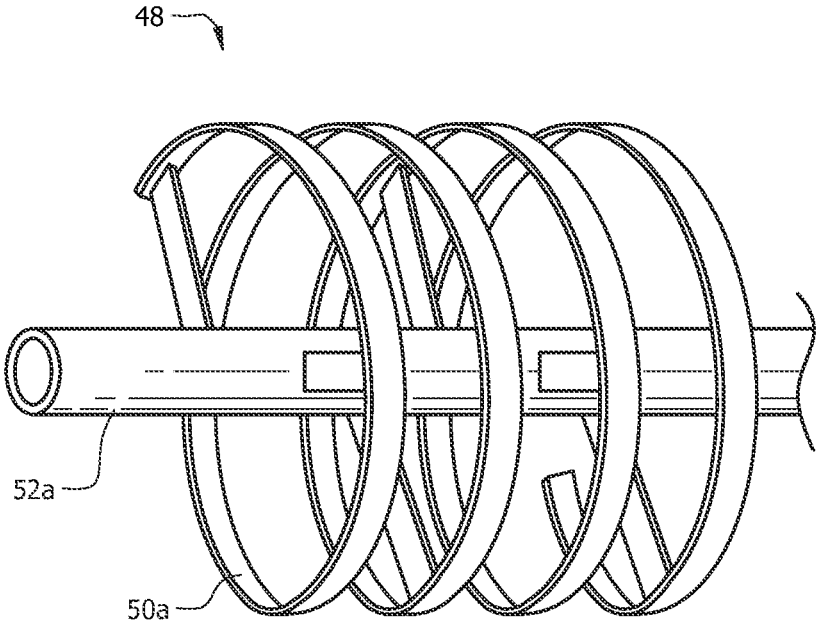
FIG. 4A is a close-up view of a counter auger used in a fiber dispenser according to an embodiment of the current invention.
Figure 4B:
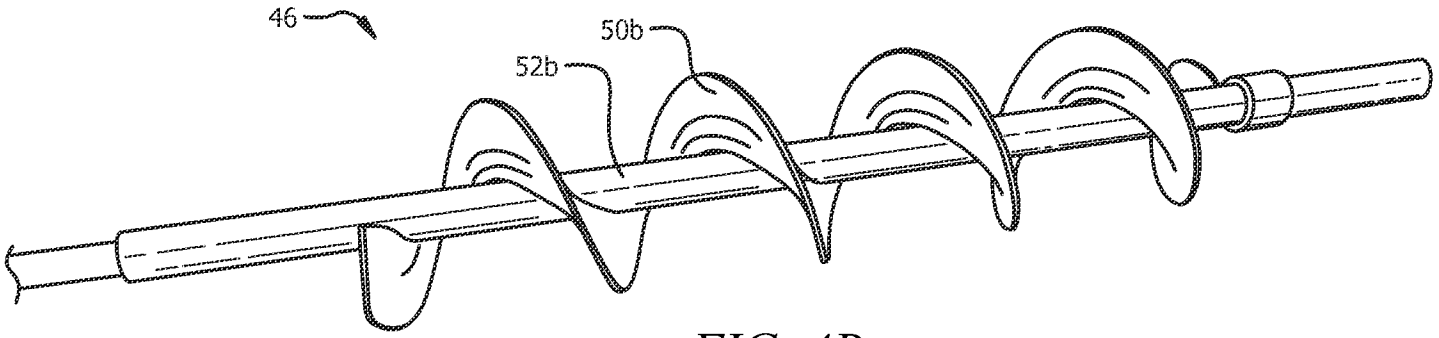
FIG. 4B is a close-up view of a feed auger used in a fiber dispenser according to an embodiment of the current invention.
Figure 5:
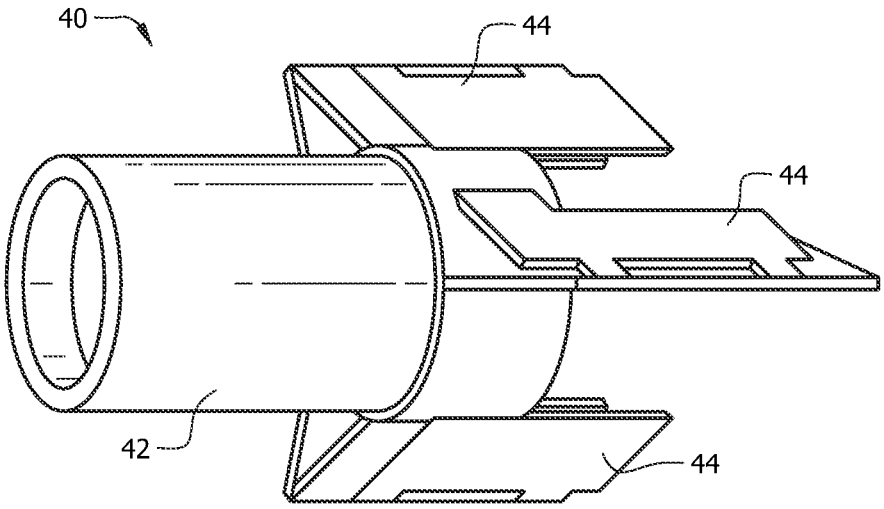
FIG. 5 is a close-up view of a declumping apparatus used in a fiber dispenser according to an embodiment of the current invention.
Figure 8:
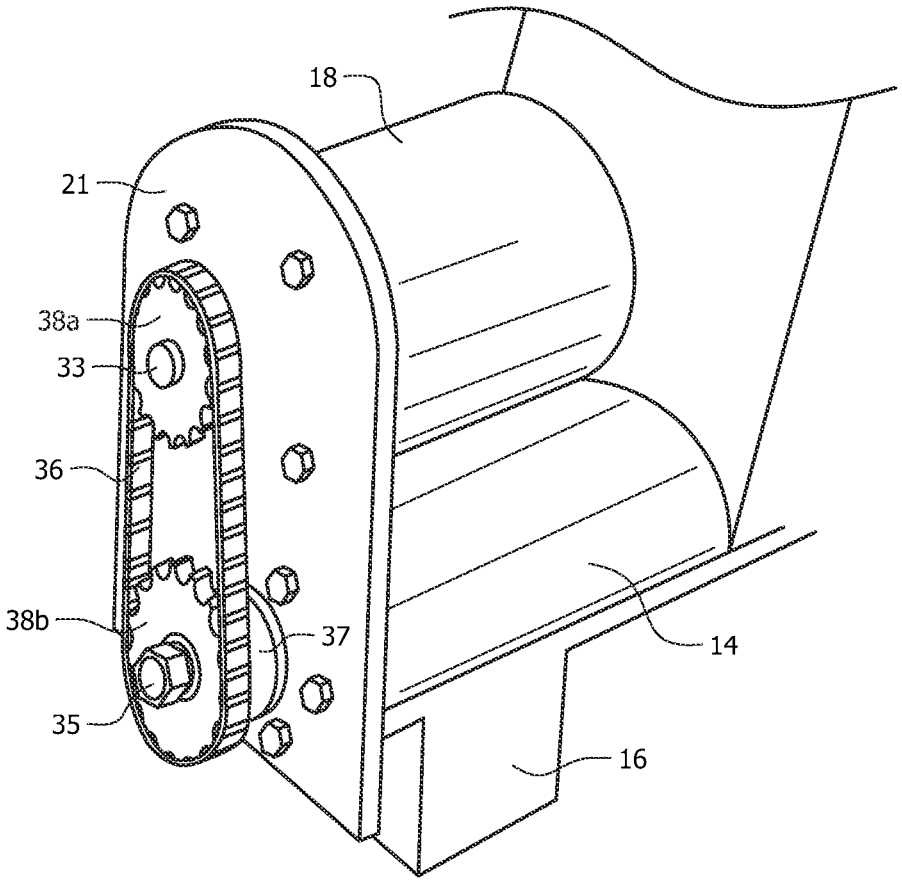
FIG. 8 is a close-up perspective view of exemplary mechanisms used to rotate a declumping apparatus in a fiber dispenser according to an embodiment of the current invention.

FIG. 4A is a close-up view of counter auger 48. FIG. 4B is a close-up view of feed auger 46. FIG. 5 is a close-up view of declumping apparatus 40. FIGS. 6-7 show the gear mechanisms that operate feed auger 46 and counter auger 48. FIG. 8 shows the gear mechanisms that operate declumping apparatus 40. In total, FIGS. 3-8 show the interior aspects of apparatus 10.

Motor 20 can be a hydraulic motor that is coupled to a field vehicle's main hydraulic pump (not shown) via hydraulic hoses (not shown), as understood by one of ordinary skill in the art at the time of this invention, for powering rotation of feed auger 46 and counter auger 48.

Motor 18 can be a 12-volt D/C motor that is wired into the field vehicle's electrical panel, as understood by one of ordinary skill in the art at the time of this invention, for powering rotation declumping apparatus 40.

Counter auger 48 is formed of shaft 52*a* and fighting 50*a* secured thereto and disposed therearound. Feed auger 46 is formed of shaft 52*b* and fighting 50*b* secured thereto and disposed therearound. Feed auger 46 is positioned substantially directly underneath counter auger 48 within auger housing 14, such that feed auger 46 and counter auger 48 typically are substantially parallel to one another. Flighting 50*b* of feed auger 46 and counter auger 48 can be formed of any type, including, but not limited to, continuous fighting (helical flange around shaft 52*b*), sectional fighting, ribbon infighting (continuous helix positioned around shaft 52*b*, as seen in FIGS. 3 and 4), single fighting, double flighting, tapered fighting, cut fighting, cut and folded fighting, and fighting with paddles.

FIG. 4A depicts an exemplary embodiment of counter auger 48 with fighting 50*a* that is structured to allow the fiber to follow a path of travel through counter auger 48 to feed auger 46. Typically, as seen in FIG. 4B, feed auger 46 has thicker cylindrical fighting 50*b*, as the purpose of feed auger 46 is to urge the fiber horizontally toward declumping apparatus 40, whereas the purpose of counter auger 48 is to allow the fiber to fall vertically through counter auger 48 without clumping or bridging.

Flighting 50*b* of feed auger 46 has a diameter and pitch in a direction toward discharge chute 16, so that the pre-cut fiber travels through feed auger 46 toward discharge chute 16 and is discharged through chute 16 (e.g., via the force of gravity). In an embodiment, counter auger 48 has a diameter about two (2) times the diameter of feed auger 46.

Additionally, feed auger 46 and counter auger 48 each rotate, such that feed auger 46 rotates in the same direction as counter auger 48. Regardless of specific direction (i.e., clockwise or counterclockwise), feed auger 46 must rotate in a direction that allows the pre-cut fiber to travel through feed auger 46 toward discharge chute 16 and be discharged through chute 16. For example, in the embodiment of FIG. 3, feed auger 46 would rotate in a clockwise direction, so that the pre-cut fiber is urged toward discharge chute 16. In this case, counter auger 48 would rotate in a clockwise direction since it rotates in the same direction as feed auger 46.

Declumping apparatus 40 is coupled to and is substantially concentric with feed auger 46. Declumping apparatus 40 is positioned and rotates above discharge chute 16, so when pre-cut fiber enters declumping apparatus 40, the pre-cut fiber is directed downwardly through discharge chute 16. Structurally, declumping apparatus 40 is formed of shaft 42 and planar blades 44. Shaft 42 has an end that is coupled to shaft 52*b* of feed auger 46. The attachment between shaft 42 and shaft 52*b* may be achieved in any suitable manner. For example, shaft 42 of declumping apparatus 40 may be telescopically received by shaft 52*b* of feed auger 46 within the interior of shaft 52*b* of feed auger 46. Blades 44 are substantially planar structures extending from shaft 42, such that when blades 44 rotate with declumping apparatus 40 and with feed auger 46, blades 44 urge the pre-cut fiber downwardly toward and through discharge chute 16.

FIGS. 6-7 depict the internal mechanisms within gear housing 24 and mounted on mounting plate 23. These mechanisms power or control the rotation of feed auger 46 and counter auger 48. The mechanisms include a belt or chain drive system that has driving and driven gears and shafts with multiple belts/chains. Driving shaft 25 is a power takeoff shaft that is coupled to motor 20. Driving shaft 25 is disposed through base 53 secured on mounting plate 23. Power drive 30*b* is mounted on driving shaft 25 and is configured to secure or "grab" an end of track (e.g., chain or belt) 26*b* for rotation, as seen in FIGS. 3, 6, and 7.

Primary driven shaft 32 is positioned substantially directly above driving shaft 25 and leads to and becomes shaft 52*b* of feed auger 46 within auger housing 14, as seen in FIG. 3. Driven shaft 32 is disposed through shaft bearing 27 secured on mounting plate 23, where driven shaft 32 can be turned on bearing 27. Sprocket 30*a* is mounted on driven shaft 32 and includes teeth, cogs, or other radially-projecting projection or structure configured to secure or "grab" an end of track 26*b* for rotation, where the end of track 26*b* grabbed by sprocket 30*a* is opposite from the end grabbed by power drive 30*b*. Thus, track 26*b* rotates about sprocket 30*a* and power drive 30*b*. The rotation of sprocket 30*a* causes feed auger 46 to rotate, as well as controls the speed of rotation of feed auger 46. It is contemplated that the speed of rotation of feed auger 46 can be constant, increased, or decreased.

Track 26*b*, sprocket 30*a*, and power drive 30*b* are vertically oriented relative to the horizontal longitudinal axis of driving shaft 25 and driven shaft 32.

Power drive 28*b* is mounted on driven shaft 32 and is configured to secure or "grab" an end of track (e.g., chain or belt) 26*a* for rotation, as seen in FIGS. 3, 6, and 7.

Auxiliary driven shaft 34 is positioned substantially directly above primary driven shaft 32 and leads to and becomes shaft 52*a* of counter auger 46 within hopper 12, as seen in FIG. 3. Driven shaft 34 is disposed through shaft bearing 29 secured on mounting plate 23, where driven shaft 34 can be turned on bearing 29. Sprocket 28*a* is mounted on driven shaft 34 and includes teeth, cogs, or other radially-projecting projection or structure configured to secure or "grab" an end of track 26*a* for rotation, where the end of track 26*a* grabbed by sprocket 28*a* is opposite from the end grabbed by power drive 28*b*. Thus, track 26*a* rotates about sprocket 28*a* and power drive 28*b*. The rotation of sprocket 28*a* causes counter auger 48 to rotate, as well as controls the speed of rotation of counter auger 48. It is contemplated that the speed of rotation of counter auger 48 can be constant, increased, or decreased.

Track 26*a*, sprocket 28*a*, and power drive 28*b* are vertically oriented relative to the horizontal longitudinal axis of primary driven shaft 32 and auxiliary driven shaft 34.

As discussed previously, counter auger 48 and feed auger 46 rotate in the same direction, such that if counter auger 48 rotates in a counterclockwise direction, feed auger 46 would also rotate in a counterclockwise direction, and vice versa. The current invention contemplates any mechanism of achieving this rotation, as would be understood by one of ordinary skill in the art. In order to achieve this within the current example, though, sprocket 28*a* and sprocket 28*b* would rotate in the same direction. This can be performed, for example, via power drive 28*b* rotating in the same direction as power drive 30*b*, thus driving rotation of track 26*a* and sprocket 28*a* in the same direction as power drive 28*b*.

FIG. 8 depicts the internal mechanism within gear housing 22 and mounted on mounting plate 21. These mechanisms power or control the rotation of declumping apparatus 40. The mechanisms include a belt or chain drive system that has driving and driven gears and shafts with a track (e.g., belt, chain, etc.). Driving shaft 33 is a power takeoff shaft or electric motor shaft that is coupled to motor 18. Sprocket 38*a* is mounted on driving shaft 33 and includes teeth, cogs, or other radially-projecting projection or structure configured to secure or "grab" an end of track (e.g., chain or belt) 36 for rotation, as seen in FIGS. 3 and 8.

Driven shaft 35 is positioned substantially directly below driving shaft 33 and can lead to and become shaft 52.*b* of teed auger 46 within auger housing 14, as seen in FIG. 3. Driven shaft 35 is disposed through base 37 secured on mounting plate 21. Sprocket 38*b* is mounted on driven shaft 35 and includes teeth, cogs, or other radially-projecting projection or structure configured to secure or "grab" an end of track 36 for rotation, where the end of track 36 grabbed by sprocket 30*b* is opposite from the end grabbed by power drive 38*a*. Thus, track 36 rotates about sprocket 38*a* and sprocket 38*b*. The rotation of sprocket 38*b* causes declumping apparatus 40 to rotate, as well as controls the speed of rotation of declumping apparatus 40. It is contemplated that the speed of rotation of declumping apparatus 40 can be constant, increased, or decreased.

Track 36, sprocket 38*a*, and sprocket 38*b* are vertically oriented relative to the horizontal longitudinal axis of driving shaft 33 and driven shaft 35.

The current invention contemplates that optionally, primary driven shaft 32, shaft 52*b* of feed auger 46, and driven shaft 35 are contiguous and form a single elongate shaft disposed across auger housing 14 with ends disposed in gear housing 22 and gear housing 24. This can be seen in FIG. 3. In this case, it is envisioned that shaft 42 of declumping apparatus 40 receives shaft 52*b* of feed auger 46, such that shaft 52*b* of feed auger 46 is disposed through the hollow interior of shaft 42 of declumping apparatus 40.

In operation, using exemplary embodiment 10 of a mobile fiber dispenser according to the current invention, 12V D/C motor 18 and hydraulic motor 20 are activated via a field vehicle's electrical panel and hydraulic pump, respectively, or other power sources. Connecting motors 18 and 20 to a field vehicle as a power source, as understood by one of ordinary skill in the art, allows fiber dispenser 10 to be mobile in nature. Alternatively, motors 18 and 20 can be connected to alternative power sources (not shown), as known in the art, to provide power to the mechanisms of apparatus 10.

Activating hydraulic motor 20 initiates rotation of driving shaft 25, which in turn initiates rotation of first power drive 30*b*, first track 26*b*, first sprocket 30*a*, primary or first driven shaft 32, second power drive 28*b*, second track 26*a*, second sprocket 28*a*, and auxiliary or second driven shaft 34. Second track 26*a* and second sprocket 28*a* rotate in the same direction as first track 26*b* and first sprocket 28*b*, as discussed previously. This mechanism initiates rotation of feed auger 46 and counter auger 48, as discussed previously. The rotation of these various elements can be controlled via inductive sensor 54, which have targets 54' on base 53 through which driving shaft 25 is disposed. Thus, rotation of feed auger 46 and counter auger 48 can be increased, decreased, stabilized, or kept constant.

Activating D/C motor 18 initiates rotation of driving shaft 33, which in turn initiates rotation of first sprocket 38*a*, track 36, second sprocket 38*b*, and driven shaft 35, as discussed previously. This mechanism initiates rotation of declumping apparatus 40 in any direction (e.g., clockwise, counterclockwise) desired, as discussed previously. The rotation of these elements can be controlled (e.g., increased or decreased) or kept at a constant rate, thus effecting rotational speed of declumping apparatus 40, depending on the needs of the user.

Before or after activation of motor 18 and motor 20 (and thus rotation of feed auger 46, counter auger 48, and declumping apparatus 40), a fibrous material (e.g., steel fibers, glass fibers, synthetic fibers, natural fibers) can be loaded or otherwise placed in hopper 12. The fibers contact counter auger 48 (located within the interior of hopper 12), which, by rotating, keeps the fibers from clumping and bridging inside hopper 12. As the fibers continue to travel downwardly past counter auger 48, the fibers contact feed auger 46 (located within auger housing 14 beneath hopper 12), which, by having a particular pitch and rotating in a specific direction, as discussed, direct the fibers toward declumping apparatus 40 located at an end of feed auger 48. Declumping apparatus 40 can rotate at a predetermined constant speed and intercepts the fibers as the fibers are urged out of feed auger 46. Declumping apparatus 40 provides an even distribution of the fibers as fibers 56 fall or are otherwise discharged through discharge 16 into the mixing process or collection chamber (not seen).

Figure 9:
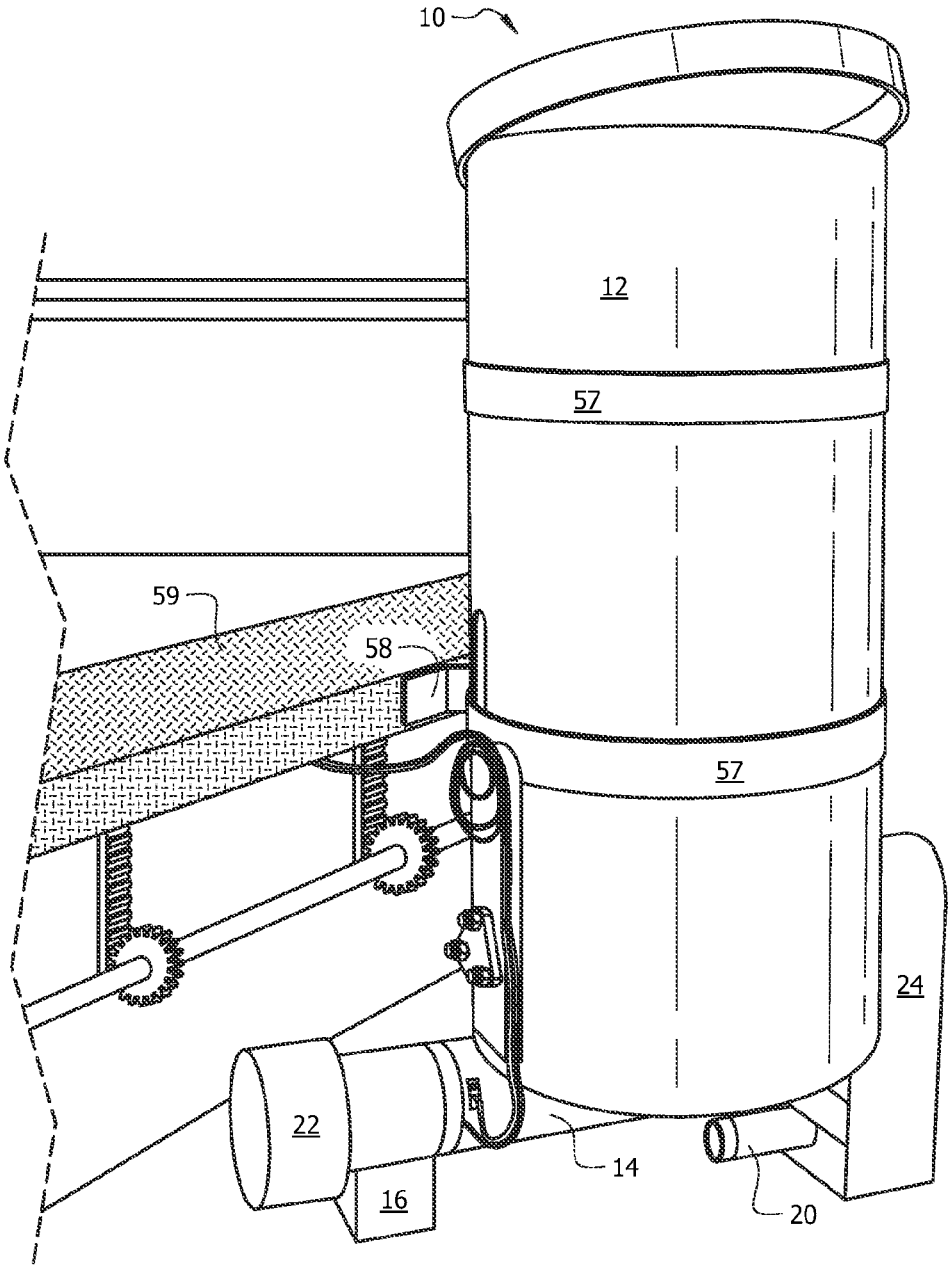
FIG. 9 is a close-up perspective view of an embodiment of the current invention mounted onto a field vehicle.

FIG. 9 shows how apparatus 10 may secured to a field vehicle, denoted by the reference numeral 59, such as a field vehicle described previously. Mounting straps 57 can be disposed around the circumference of hopper 12. Mounting straps 57 can be secured to field vehicle 59 via mounting brackets 58.

GLOSSARY OF CLAIM TERMS

Additive: This term is used herein to refer to any suitable supplementary material needed for even and automated distribution into a base material. An example of an additive is fibrous material.

Base material: This term is used herein to refer to any foundation or root material whose characteristics can be enhanced by the addition of an additive. An example of a base material is cement or asphalt.

Belt or chain drive system: This term is used herein to refer to any mechanism with belts, chains, sprockets, power drives, and/or other relevant components that would facilitate the rotation of a counter auger, feed auger, and declumping apparatus.

Counter auger: This term is used herein to refer to an apparatus having a shaft or shank with threads or fighting disposed therearound. A counter auger has a particular pitch and direction that allows fiber or other additive to be directed toward the feed auger without clumping or bridging inside the hopper.

Declumping apparatus: This term is used herein to refer to a device or apparatus that may include a plurality of blades or other components that rotate to filter and direct fiber or other additive toward an output system, such as a discharge chute.

Output system: This term is used herein to refer to any device that outputs or applies the filtered fiber or other additive to another system.

Direction of rotation: This term is used herein to refer to any path of motion of an apparatus, such as a counter or feed auger, that is capable of rotation about a line of axis. For example, a direction of rotation can be clockwise or counter-clockwise.

Discharge chute: This term is used herein to refer to a structure that contains a passage or avenue for a fluid or flowing substance. For example, fiber can enter a discharge chute that leads to subsequent portions of an output system.

Dispenser: This term is used herein to refer to a machine or device that is used to distribute other items or materials. For example, a fiber dispenser distributes fiber from a source (e.g., a hopper) to an end destination (e.g., funnel, output system, concrete mix, discharge chute, etc.).

Even distribution: This term is used herein to refer to a consistent, regular, stable dispersal of the additive to the output system.

Feed auger: This term is used herein to refer to an apparatus having a shaft or shank with threads or fighting disposed therearound. A feed auger has a particular pitch and direction that urges or directs fiber or other additive toward the declumping apparatus for discharge through or to the output system.

Auger housing: This term is used herein to refer to a casing or cover for a feed auger, where the interior of the auger housing is in open communication with the interior of the hopper, for example by having an open top, where the hopper would have an open bottom that matches the open top of the auger housing. The auger housing and hopper are in communication such that fiber or other additive can follow a path of travel from the hopper (containing the counter auger) to the auger housing (containing the feed auger).

Fibrous material: This term is used herein to refer to continuous or discrete elongates pieces that are formed from filamentous material, such as glass or other synthetic or natural material. Fiber can be blended into a concrete or asphalt mix to provide a number of advantages, as previously discussed.

Field vehicle: This term is used herein to refer to a device that can be coupled to the mobile fiber dispenser on a job site for powering the dispenser in order to dispense fiber or other additive "on demand".

Hopper: This term is used herein to refer to a hollow container for transport, blending, and/or storage of a fluid or other material. The hopper can receive an additive and funnel it through a discharge or output system proximal to the bottom of the hopper.

Inductive sensor: This term is used herein to refer to an electronic proximity sensor that aids in increasing or decreasing speed of rotation of the counter auger and feed auger. The inductive sensor provides a signal to an LED panel display or other electronic device, possibly mounted on the dispenser, so that the operator can control the speed of the hydraulic motor manually or automatically.

Motor: This term is used herein to refer to any power source for the functioning of a device, such as counter auger, feed auger, or declumping apparatus within the current invention.

Patterned distribution: This term is used herein to refer to a designed dispersal of the additive based on time and amount of the additive.

Planar blade: This term is used herein to refer to a substantially flat projecting edge at least a portion of a declumping apparatus, where the planar blade facilitates the filtering of fiber or other additive by driving the fiber downward toward the output system.

Sensor target: This term is used herein to refer to an object or component intended to be detected by an inductive sensor in order to facilitate an increase or decrease of speed of rotation of the counter auger and feed auger.

Substantially hollow: This term is used herein to refer to the amount of vacancy within a hopper, drum, or other reservoir to the extent that the addition of any structures within that hopper, drum, or reservoir does not effectively hinder the overall function of the apparatus (i.e., dispenser).

Substantially impermeable: This term is used herein to refer to a material that does not readily or easily allow the passage of another fluid or solid to the extent that any allowance of passage of another fluid or solid does not effectively hinder the overall function of the apparatus (i.e., dispenser).

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A dispenser for even or patterned distribution of an additive into a base material, comprising:

a hopper having a substantially impermeable outer all and a substantially hollow interior for receiving said additive;

a horizontally-oriented counter auger disposed within said hopper, said counter auger rotating in a first direction;

a horizontally-oriented feed auger positioned in underlying relation to said counter auger such that said additive follows a path of travel from said counter auger to said feed auger, said feed auger rotating in a second direction, said first direction and said second direction being the same as each other;

a rotating declumping apparatus associated with said feed auger such that said additive follows a path of travel from said feed auger to said declumping apparatus;

one or more motors for powering or controlling said counter auger, said feed auger, and said declumping apparatus, said one or more motors powering or controlling said counter auger and said feed auger through a belt or chain drive system;

an inductive sensor in electrical communication with said one or more motors that powers or controls said counter auger and said feed auger, said inductive sensor controlling speed of rotation of said counter auger and said feed auger;

a sensor target on said belt or chain drive system that drives rotation of said counter auger and said feed auger; and an output system associated with said declumping apparatus such that said additive follows a path of travel from said declumping apparatus to said output system, said output system receiving said additive as said additive exits said feed auger and said declumping apparatus.

2. A dispenser as in claim 1, further comprising:

said additive being a fibrous material.

3. A dispenser as in claim 1, further comprising:

said base material being concrete, cement, or asphalt.

4. A dispenser as in claim 1, further comprising:

an inductive sensor in electrical communication with said one or more motors that powers or controls said counter auger and said feed auger, said inductive sensor controlling speed of rotation of said counter auger and said feed auger.

5. A dispenser as in claim 1, further comprising:

said one or more motors including a hydraulic motor that powers or controls said counter auger and said feed auger.

6. A dispenser as in claim 5, further comprising:

said hydraulic motor connected to a hydraulic pump of a field vehicle that is utilizing said mobile dispenser.

7. A dispenser as in claim 1, further comprising:

said one or more motors including a direct current motor that powers or controls said declumping apparatus.

8. A dispenser as in claim 7, further comprising:

said direct current motor connected to an electrical panel of a field vehicle that is utilizing said mobile dispenser.

9. A dispenser as in claim 1, further comprising:

said declumping apparatus having at constant speed of rotation when activated.

10. A dispenser as in claim 1, further comprising:

said output system including a vertically-directed discharge chute positioned in direct underlying relation to said declumping apparatus, said discharge chute receiving said additive upon exiting said declumping apparatus.

11. A dispenser as in claim 1, further comprising:

an auger housing positioned in underlying relation to said hopper, said auger housing being in open communication with said hopper, said auger housing containing said feed auger and said declumping apparatus.

12. A dispenser as in claim 1, further comprising:

said declumping apparatus coupled to and concentric with said feed auger, such that said additive follows a path of travel horizontally from said feed auger to said declumping apparatus.

13. A dispenser as in claim 1, further comprising:

said one or more motors powering or controlling said declumping apparatus through a belt or chain drive system.

14. A dispenser as in claim 1, further comprising:

said declumping apparatus including a plurality of planar blades that drive said additive toward said output system.

15. A mobile dispenser for even or patterned distribution of a fibrous material into concrete, cement, or asphalt, comprising:

a hopper having a substantially impermeable outer wall and a substantial hollow interior for receiving said fibrous material;

a horizontally-oriented counter auger disposed within said hopper, said counter auger rotating in a first direction;

an auger housing positioned in underlying relation to said hopper, said auger housing being in open communication with said hopper;

a horizontally-oriented feed auger positioned within said auger housing in underlying relation to said counter auger such that said fibrous material follows a path of travel from said counter auger to said feed auger, said feed auger rotating in a second direction, said first direction and said second direction being the same as each other;

a rotating declumping apparatus positioned within said auger housing, said declumping apparatus coupled to and concentric with said feed auger such that said fibrous material follows a path of travel horizontally from said feed auger to said declumping apparatus, said declumping apparatus having at constant speed of rotation when activated;

one or more motors for powering or controlling said counter auger, said feed auger, and said declumping apparatus, said one or more motors including a hydraulic motor that powers or controls said counter auger and said feed auger through a first belt or chain drive system, said hydraulic motor connected to a hydraulic pump of a field vehicle that is utilizing said mobile dispenser, said one or more motors including a direct current motor that powers or controls said declumping apparatus through a second belt or chain drive system, said direct current motor connected to an electrical panel of said field vehicle that is utilizing said mobile dispenser;

an inductive sensor in electrical communication with said one or more motors that powers or controls said counter auger and said feed auger, said inductive sensor controlling speed of rotation of said counter auger and said feed auger;

a sensor target on said first belt or chain drive system that drives rotation of said counter auger and said feed auger; and a vertically-directed discharge chute positioned in direct underlying relation to said declumping apparatus such that said fibrous material follows a path of travel from said declumping apparatus vertically through said discharge chute, said discharge chute receiving said fibrous material as said fibrous material exits said feed auger and said declumping apparatus.

* * * * *

UNITED STATES PATENT AND TRADEMARK OFFICE

CERTIFICATE OF CORRECTION

PATENT NO. : 9,132,952 B1
APPLICATION NO. : 14/151410
DATED : September 15, 2015
INVENTOR(S) : Darrell Knepp It is certified that error appears in the above-identified patent and that said Letters Patent is hereby corrected as shown below:

Claims

Column 12, Claim 1, Line 52 should read:

a hopper having a substantially impermeable outer wall and

Signed and Sealed this
Second Day of February, 2016

Michelle K. Lee

Michelle K. Lee
*Director of the United States Patent and Trademark Office*